US009579541B2

(12) United States Patent
Zhao et al.

(10) Patent No.: US 9,579,541 B2
(45) Date of Patent: Feb. 28, 2017

(54) REMOVABLE MOTION SENSOR EMBEDDED IN A SPORT INSTRUMENT

(71) Applicant: Zepp Labs, Inc., Los Gatos, CA (US)

(72) Inventors: Ke Zhao, Beijing (CN); Zheng Han, Beijing (CN)

(73) Assignee: Zepp Labs, Inc., Los Gatos, CA (US)

( * ) Notice: Subject to any disclaimer, the term of this patent is extended or adjusted under 35 U.S.C. 154(b) by 0 days.

(21) Appl. No.: 14/657,620

(22) Filed: Mar. 13, 2015

(65) Prior Publication Data

US 2015/0360081 A1 Dec. 17, 2015

Related U.S. Application Data

(60) Provisional application No. 62/011,530, filed on Jun. 12, 2014.

(51) Int. Cl.
*A63B 69/36* (2006.01)
*A63B 24/00* (2006.01)
(Continued)

(52) U.S. Cl.
CPC ..... *A63B 24/0021* (2013.01); *A63B 69/0002* (2013.01); *A63B 69/0017* (2013.01);
(Continued)

(58) Field of Classification Search
CPC ..... A63B 69/36; A63B 2220/833; A63B 24/0006; A63B 2225/50; A63B 24/0003;
(Continued)

(56) References Cited

U.S. PATENT DOCUMENTS 5,610,590 A 3/1997 Johnson et al.
5,766,088 A * 6/1998 Severtsen ..... A63B 60/24 473/297
(Continued)

FOREIGN PATENT DOCUMENTS

WO WO 2013/174922 A1 11/2013

OTHER PUBLICATIONS

PCT International Search Report and Written Opinion for PCT/US15/20576, Jun. 23, 2015, 11 Pages.
(Continued)

*Primary Examiner* — Nini Legesse
(74) *Attorney, Agent, or Firm* — Fenwick & West LLP

(57) ABSTRACT

A solution is provided to enhance motion detection and recognition of moving objects associated with various sports by intelligently embedding motion sensors into sport instruments such as tennis rackets, badminton rackets, baseball bats and golf clubs, that are swung in a three-dimensional (3D) space. The motion sensors embedded inside the sport instruments are securely locked and are detachable for replacement. A motion sensor inserted and locked inside a sport instrument is configured to detect motions associated with movements associated with the sport instrument. The motion parameters associated with the detected motion are collected through the embedded motion sensor and analyzed by a motion detection and recognition system. Based on the analysis of the motion parameters, various types of sports performance reports and performance improvement recommendations are generated for users of the sport instruments.

20 Claims, 13 Drawing Sheets

INSERT & LOCK

(51) Int. Cl.
*A63B 69/38* (2006.01)
*A63B 69/00* (2006.01)

(52) U.S. Cl.
CPC ..... *A63B 69/36* (2013.01); *A63B 69/38* (2013.01); *A63B 2024/0028* (2013.01); *A63B 2024/0056* (2013.01); *A63B 2069/0008* (2013.01); *A63B 2208/0204* (2013.01); *A63B 2220/803* (2013.01); *A63B 2220/833* (2013.01)

(58) Field of Classification Search
CPC . A63B 2220/40; A63B 24/00; A63B 24/0062; A63B 69/3632; A63B 59/0074; A63B 2220/12; A63B 2220/34; A63B 2243/0029
USPC ..... 473/131, 221, 222, 223, 549, 409
See application file for complete search history.

(56) References Cited

U.S. PATENT DOCUMENTS

| | | | | |
|---|---|---|---|---|
| 5,819,206 | A | 10/1998 | Horton et al. | |
| 6,224,493 | B1 | 5/2001 | Lee et al. | |
| 7,978,081 | B2 | 7/2011 | Shears et al. | |
| 8,109,816 | B1 | 2/2012 | Grober | |
| 8,282,487 | B2 | 10/2012 | Wilson et al. | |
| 8,337,335 | B2 | 12/2012 | Dugan | |
| 8,409,024 | B2 | 4/2013 | Marty et al. | |
| 8,409,025 | B2 | 4/2013 | Stites et al. | |
| 8,449,402 | B2 | 5/2013 | Jaekel et al. | |
| 8,523,696 | B2 | 9/2013 | Kamino et al. | |
| 8,589,114 | B2 | 11/2013 | Papadourakis | |
| 8,593,286 | B2 | 11/2013 | Razoumov et al. | |
| 8,725,452 | B2 | 5/2014 | Han | |
| 8,840,483 | B1 * | 9/2014 | Steusloff et al. | 473/222 |
| 8,903,521 | B2 | 12/2014 | Goree et al. | |
| 8,905,855 | B2 | 12/2014 | Fitzpatrick et al. | |
| 8,941,723 | B2 | 1/2015 | Bentley et al. | |
| 8,944,928 | B2 | 2/2015 | Kaps et al. | |
| 8,956,238 | B2 | 2/2015 | Boyd et al. | |
| 9,039,527 | B2 | 5/2015 | Bentley et al. | |
| 2002/0173364 | A1 * | 11/2002 | Boscha | 473/131 |
| 2005/0032582 | A1 | 2/2005 | Mahajan et al. | |
| 2005/0261073 | A1 * | 11/2005 | Farrington et al. | 473/221 |
| 2005/0272516 | A1 | 12/2005 | Gobush | |
| 2006/0025229 | A1 | 2/2006 | Mahajan et al. | |
| 2006/0166738 | A1 | 7/2006 | Eyestone et al. | |
| 2008/0085778 | A1 | 4/2008 | Dugan | |
| 2009/0048044 | A1 | 2/2009 | Oleson et al. | |
| 2009/0111602 | A1 * | 4/2009 | Savarese et al. | 473/283 |
| 2009/0233735 | A1 * | 9/2009 | Savarese et al. | 473/407 |
| 2010/0103269 | A1 | 4/2010 | Wilson et al. | |
| 2010/0144414 | A1 | 6/2010 | Edis et al. | |
| 2010/0323794 | A1 | 12/2010 | Su | |
| 2012/0157241 | A1 * | 6/2012 | Nomura et al. | A63B 69/0002 473/422 |
| 2012/0277017 | A1 * | 11/2012 | Boyd et al. | A63B 24/0003 473/223 |
| 2012/0277890 | A1 | 11/2012 | Han | |
| 2012/0295726 | A1 * | 11/2012 | Cherbini | 473/222 |
| 2013/0053190 | A1 | 2/2013 | Mettler | |
| 2013/0065703 | A1 * | 3/2013 | Rose | 473/223 |
| 2013/0095941 | A1 * | 4/2013 | Bentley et al. | 473/223 |
| 2013/0319113 | A1 | 12/2013 | Mizuta | |

OTHER PUBLICATIONS

Allen, R., "Wireless Sensor Architecture Uses Bluetooth Standard" Electronic Design, Aug. 7, 2000, 5 pages, Can be retrieved from <Url:http://electronicdesign.com/communications/wireless-sensorarchitecture-uses-bluetooth-standard>.

Arfwedson, H., et al., "Ericsson's Bluetooth Modules," Ericsson Review, 1999, No. 4, pp. 198-205, <Url:http://www.ericsson.com/ericsson/corpinfo/Pub.s/review/1999_04/files/19990404.pdf>.

Bishop, R., "LabVIEW 8 Student Edition," 2007, 12 pages, Pearson Prentice-Hall, Upper Saddle River, NJ.

First Annual "Better Golf Through Technology," Better Golf Through Technology Conference, Feb. 17-18, 2006, 1 page, [Archived on web.archive.org on Mar. 14, 2006] Can be Retrieved at <Url:https://web.archive.org/web/20060314063211/http:/www.bettergolfthroughtechnology.com/>.

Home page for "Concept2: Training," 1 page, [Archived on web.archive.org on Feb. 5, 2009] Can be Retrieved at <Url:http://web.archive.org/web/20090205092657/http://concept2.com/us/training/defaultasp>.

Home page for Expresso.com, 2 pages, [Archived on web.archive.org on Apr. 29, 2009] Can be Retrieved.

Honan, M., "Apple unveils iPhone," Macworld, Jan. 89, 2007, 4 pages, can be retrieved at <Url:http://www.macworld.com/article/1054769/iphone.html>.

Invensense, "InvenSense ™ Unveils World's 1st IMU Solution for Consumer Appl.s" InvenSense, Apr. 6, 2010, 2 pages.

Kalia, M., et al., "Efficient Policies for Increasing Capacity in Bluetooth: an Indoor Pico-Cellular Wireless System," IBM India Research Laboratory, 2000, 5 pages.

Linx Technologies, "HP3 Series Transmitter Module Data Guide" Linx Technologies, Inc., 2008, Revised Jul. 27, 2011, 13 pages.

Otto, C., et al., "System Architecture of a Wireless Body Area Sensor Network for Ubiquitous Health Monitoring," Journal of Mobile Multimedia, 2006, pp. 307-326, vol. 1, No. 4.

Rao, R., et al., "Demand-based Bluetooth Scheduling," Pennsyvania State University, Sep. 27, 2001, 13 pages, Can be retrieved at <Url:http://www.cse.psu.edu/~gik2/papers/Bluetooth1.doc>.

Roving Networks, "Blue Sentry RN-8005-CB Data Sheet," 2009, 1 page.

Sanders, K., "Japanese WII Price, Release Date Revealed," IGN US, Sep. 13, 2006, 1 page, can be retrieved at <Url:http://www.ign.com/articles/2006/09/14/japanese-wii-price-release-date-revealed>.

Smartswing, "SmartSwing Introduces Affordable Intelligent Golf Club," Press Release, Jul. 19, 2005, 2 pages, [Archived on web.archive.org on Jun. 13, 2006] Can be Retrieved at <Url:https://web.archive.org/web/20060613114451/http://www.smartswinggolf.com/site/news/pr 2006_jan_23 aus.html>.

Solid State Technology, "MEMS Enable Smart Golf Clubs," Extension Media, Jan. 6, 2005, 3 pages,[Archived on web.archive.org on Jan. 15, 2016] Can be Retrieved at <Url:https://web.archive.org/web/20160115202844/http://electroiq.com/blog/2005/01/mems-enable-smartgolf-clubs/>.

Takahashi, D., "Facebook, Twitter, Last.fm coming to Xbox Live this fall" Venture Beat, Jun. 1, 2009, 5 pp., Can be retrieved from <Url:http://venturebeat.com/2009/06/01/facebook-coming-to-xbox-live-asmicrosoft-beefs-up-other-entertainment-on-xbox-360/>.

The iClub System ™ "iClub.net - Contact," Fortescue Corp. 2001-2005, 1 page, [Archived on web.archive.org on Apr. 9, 2005] Can be Retrieved at <Url:https://web.archive.org/web/20050409111624/http://www.iclub.net/contact.html>.

The iClub System ™ "iClub.net - Products," Fortescue Corp. 2001-2005, 1 page, [Archived on web.archive.org on Jul. 10, 2005] Can be Retrieved at <Url:https://web.archive.org/web/20050710075533/http://www.iclub.net/products-iclub.html.

The iClub System ™ "iClub.net — Products !Club'," Fortescue Corp. 2001-2005, 1 page, [Archived on web.archive.org on Apr. 14, 2005] Can be Retrieved at <Url:https://web.archive.org/web/20050414233840/http://www.iclub.net/products-iclube.html.

The iClub System ™ "iClub.net — Products !Club (Full Swing)," Fortescue Corp. 2001-2005, 1 page, [Archived on web.archive.org on Apr. 14, 2005] Can be Retrieved at <Url:https://web.archive.org/web/20050414233828/http://www.iclub.net/products-iclub.html.

The iClub Product Brochure, 2001-2005, 2 pages.

Tuite, D., "Motion-Sensing MEMS Gyros and Accelerometers Are Everywhere," Electronic Design, Jul. 9, 2009, 6 pages, Can be retrieved from <Url:http://electronicdesign.com/analog/motion-sensing-mems-gyrosand-accelerometers-are-everywhere>.

(56) References Cited

OTHER PUBLICATIONS

Webster's New College Dictionary, Definition for "Virtual Reality," (3rd ed. 2008), 3 pages.
Webpage for zigbees.com, 4 pp., [online] [retrieved on Mar. 14, 2016] Can be retrieved at <Url:http://www.zigbees.com/h_start.htm>.
Wheeler, a, et al., "Introduction to Engineering Experimentation," 2nd Edition, 2004, Chapter 4, 10 pages, Pearson— Prentice-Hall, Upper Saddle River, Nj.
Affidavit of Christopher Butler dated Jan. 15, 2016 regarding "Rinton Press — Publisher in Science and Technology," 6 pages, [Archived on web.archive.org on Jan. 3, 2007] Can be Retrieved at <Url:https://web.archive.org/web/20070103234656/http://rintonspress.com/journals/jmmonline.html>.
Affidavit of Christopher Butler dated Jan. 25, 2016 regarding "SmartWing Intelligent Clubs," 46 pages, [Archived on web.archive.org on Apr. 11, 2006] Can be Retrieved at <Url:https://web.archive.org/web/20060411113841/http://www.smartswinggolf.com/site/>.
Affidavit of Christopher Butler dated Feb. 19, 2016 regarding "Concept2: Training," 5 pages, [Archived on web.archive.org on Feb. 5, 2009] Can be Retrieved at <Url:http://web.archive.org/web/20090205092657/http://concept2.com/us/training/defaultasp>.
Certified File History of U.S. Pat. No. 8,905,855, Feb. 2, 2016, 709 pages.
Certified File History of U.S. Pat. No. 8,941,723, Feb. 2, 2016, 929 pages.
File History of U.S. Pat. No. 83.903.521, 406 pages.
Certified File Histroy of U.S. Pat. No. 8,944,928, Feb. 2, 2016, 647 pages.
Certified File Histroy of U.S. Pat. No. 9,039,527, Feb. 2, 2016, 1047 pages.
Declaration of Dr. Steven M. Nesbit, U.S. Pat. No. 8,905,855, Feb. 24, 2016, 235 pages.
Declaration of Dr. Steven M. Nesbit, U.S. Pat. No. 8,941,723, Feb. 24, 2016, 219 pages.
Declaration of Dr. Steven M. Nesbit, U.S. Pat. No. 8,903,521, Feb. 24, 2016, 250 pages.
Declaration of Dr. Steven M. Nesbit, U.S. Pat. No. 8,944,928, Feb. 24, 2016, 195 pages.
Declaration of Dr. Steven M. Nesbit, U.S. Pat. No. 9,039,527, Feb. 24, 2016, 227 pages.
Curriculum Vitae of Dr. Steven M. Nesbit, Feb 24, 2016, 10 pages.
Claim Limitation Reference Numbers '855 Petition, Feb. 24, 2016, 6 pages.
Claim Limitation Reference Numbers '723 Petition, Feb. 24, 2016, 5 pages.
Claim Limitation Reference Numbers '521 Petition, Feb. 24, 2016, 4 pages.
Claim Limitation Reference Numbers '928 Petition, Feb. 24, 2016, 3 pages.
Claim Limitation Reference Numbers '527 Petition, Feb. 24, 2016, 4 pages.

* cited by examiner

INSERT & LOCK

20mm * 20mm * 40mm

Dimension: 5.2mm * 6.5mm * 19.2mm

STRUCTURE ON TENNIS (SQUASH, BADMINTON) RACKET

REMOVABLE MOTION SENSOR EMBEDDED IN A SPORT INSTRUMENT

CROSS REFERENCE TO RELATED APPLICATIONS

This application claims the benefit of U.S. Provisional Application No. 62/011,530, filed on Jun. 12, 2014, which is incorporated by reference in its entirety.

BACKGROUND

This invention relates generally to motion recognition and particularly to embedding a motion sensor with a sport instrument for motion tracking and recognition.

Motion detection and recognition of a moving object, such as a golf swing, are widely used to enhance athletes' performance. The techniques for path and stance recognition for spatial accelerated motion can be used in combination with human body actions for detection of human body actions in the field of sports. Path and stance recognition for a spatial accelerated motion refers to detecting position and intersection angles of a moving object (e.g., a golf club swung by a player) at each time in the movement and obtaining real-time velocity of the mobbing object. Taking golf as an example, golf is a sport that often requires good control of motions, and an accurate analysis of the golf swing motions detected by a motion sensor can enhance golf players' performance.

To detect motion of a moving object, a motion sensor is often used to collect motion parameters associated with the moving object such as information of acceleration, velocity and position of the moving object. Some existing solutions for motion detection and recognition attach a motion sensor to the surface part of a sport instrument (e.g., rear end of a golf club, or golf gloves) used by players. However, attaching a motion sensor to the surface part of a sport instrument faces many challenges for accurate motion detection, such as making the motion sensor vulnerable for damages, affecting the holding of the sport instrument due to the attachment of the motion sensor and lack of accuracy of motion detection.

SUMMARY

Embodiments of the invention provide a solution for enhancing motion detection and recognition of moving objects associated with various sports by intelligently embedding motion sensors into sport instruments such as tennis rackets, badminton rackets, baseball bats and golf clubs, that are swung in a three-dimensional (3D) space. The motion sensors embedded inside the sport instruments are securely locked and are detachable for replacement. The shapes and sizes of motions sensors are adjustable for different types of sport instruments in a variety of shapes. The insertion and locking of a motion sensor in a sport instrument does not adversely affect a player's hold of the instrument. A motion sensor inserted and locked inside a sport instrument is configured to detect motions associated with movements associated with the sport instrument. The motion parameters associated with the detected motion are collected through the embedded motion sensor and analyzed by a motion detection and recognition system.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the disclosed subject matter.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

A solution is provided to enhance motion detection and recognition of moving objects associated with various sports by intelligently embedding motion sensors into sport instruments such as tennis rackets, badminton rackets, baseball bats and golf clubs, that are swung in a three-dimensional (3D) space. The motion sensors embedded inside the sport instruments are securely locked and are detachable for replacement. A motion sensor inserted and locked inside a sport instrument is configured to detect motions associated with movements associated with the sport instrument. The motion parameters associated with the detected motion are collected through the embedded motion sensor and analyzed by a motion detection and recognition system. Examples of the embodiments of these motion sensors and the motion detection and recognition system include some described in U.S. Patent Publication No. 2012/0277890 A1 and U.S. Pat. No. 8,725,452 B2, each of which is incorporated by reference herein in its entirety.

Figure 1:
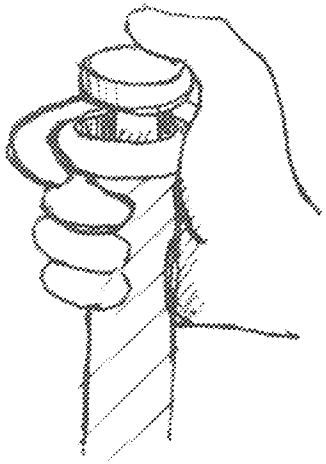
FIG. 1 is an example illustrating inserting and locking a motion sensor into a sport instrument.

FIG. 1 is an example illustrating inserting and locking a motion sensor into a sport instrument. The selected location to insert the motions sensor is the bottom of a tennis racket or a baseball bat because this part of the instrument is rarely touched by a player during the play, thus, inserting the motion sensor at the selected location can reduce the interference of the play of the instrument. Additionally, the bottom part of a tennis racket or baseball bat tends to be hollow, which provides the space to house the motion sensor.

To ease the insertion and detachment of a motion sensor, the provided solution uses spring lock mechanisms used by the secure digital (SD) memory card of the motion sensor. The spring lock mechanism enables a user to simply push the motion sensor inside a sport instrument and to unlock the motion sensor by tapping the same location again on the sport instrument.

Figure 2:
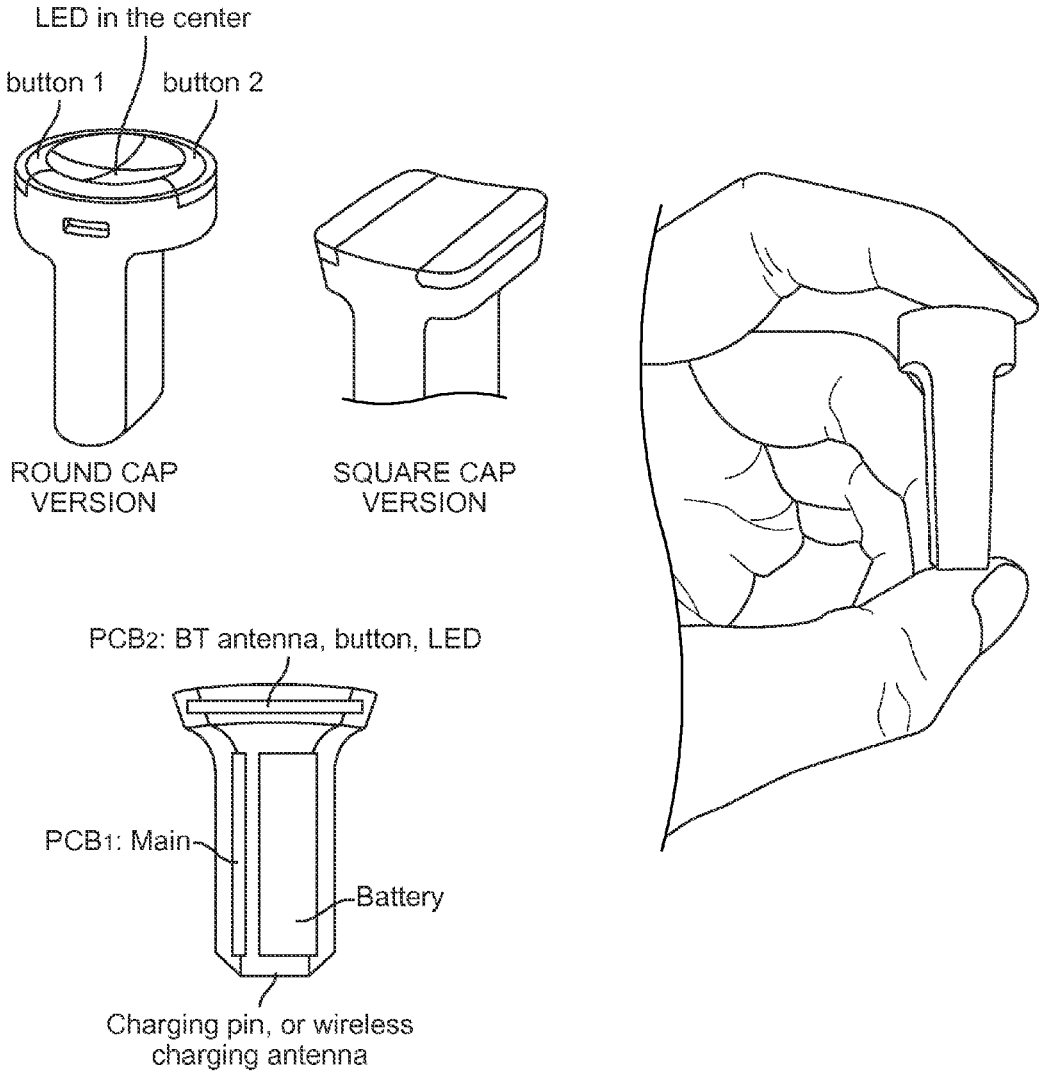
FIG. 2 illustrates different examples of a motion sensor to be inserted into a sport instrument.

FIG. 2 illustrates motion sensors in different shapes for being inserted into a sport instrument. The first example (top left figure) is a motions sensor with a round cap. The second example (top right figure) shows a motion sensor with a square cap. The motion sensor with a square cap provides more space for the printed circuit board (PCB) of the motion sensor. Additionally, the motion sensor with a square cap enlarges the button size for better user experience.

Figure 3:
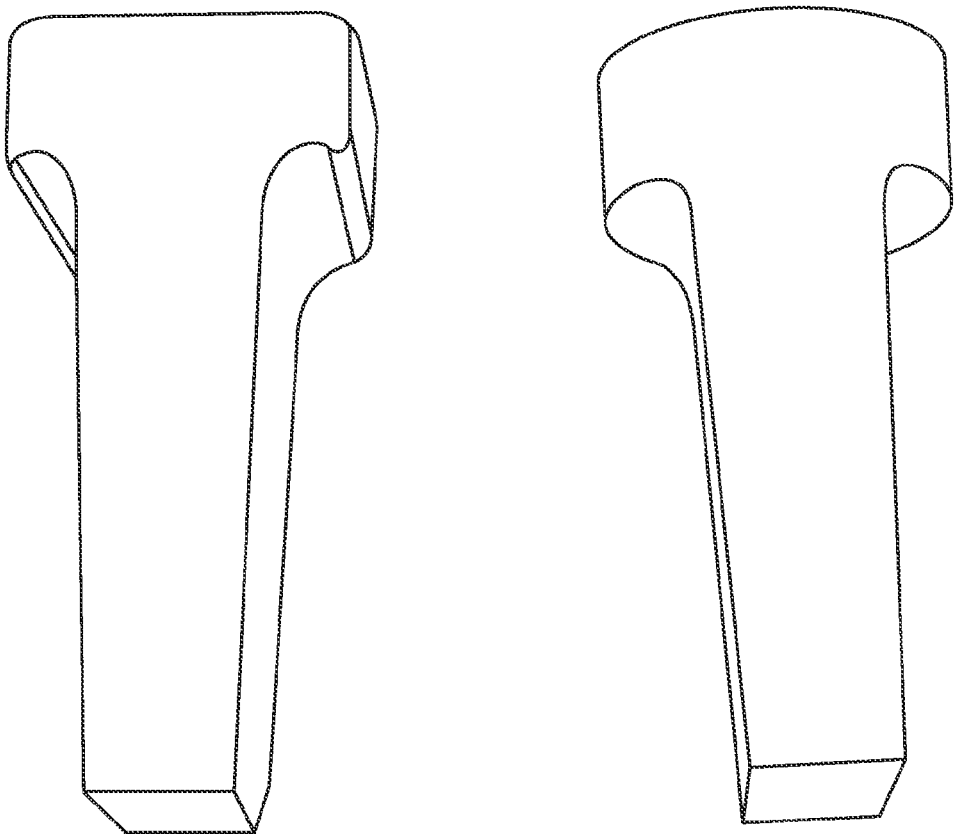
FIG. 3 shows two exemplary motion sensors in different sizes and shapes.
Figure 5:
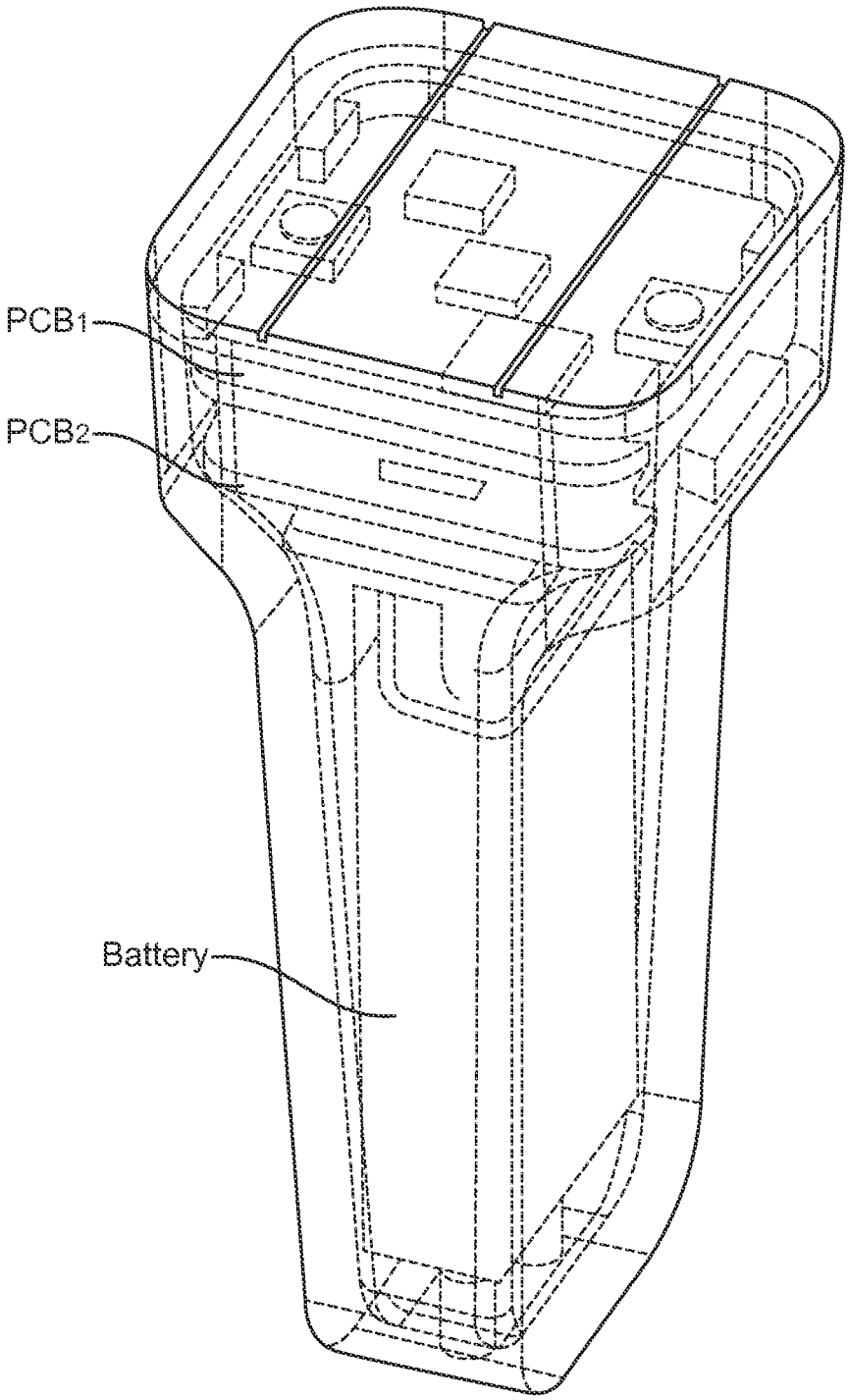
FIG. 5 shows a three-dimensional image of a motion sensor.

FIG. 2 also shows an example (bottom center figure) of parts of a motion sensor to be inserted. The motions sensor illustrated in FIG. 2 has one PCB (i.e., PCB2) at the top part of the motion sensor. Other embodiments of the motion sensor can have two or more PCBs stacked on the top part and bottom part of the motion sensor. The motion sensor also has a main PCB (i.e., PCB1), a battery and a charging ping or wireless charging antenna. The battery used by the motion sensor, in one embodiment, is thin and long to make sure the bottom part of the motion sensor can go into the tube of tennis rackets or baseball bats. FIG. 3 shows two exemplary motion sensors in different sizes and shapes, one with a square cap and the other with a round cap. Example dimensions of a motion sensor are 20 mm by 20 mm by 40 mm. FIG. 5 shows a 3D view of an example of the motion sensor having two PCBs (i.e., PCB1 and PCB2) stacked on the top part of the motion sensor.

Figure 4:
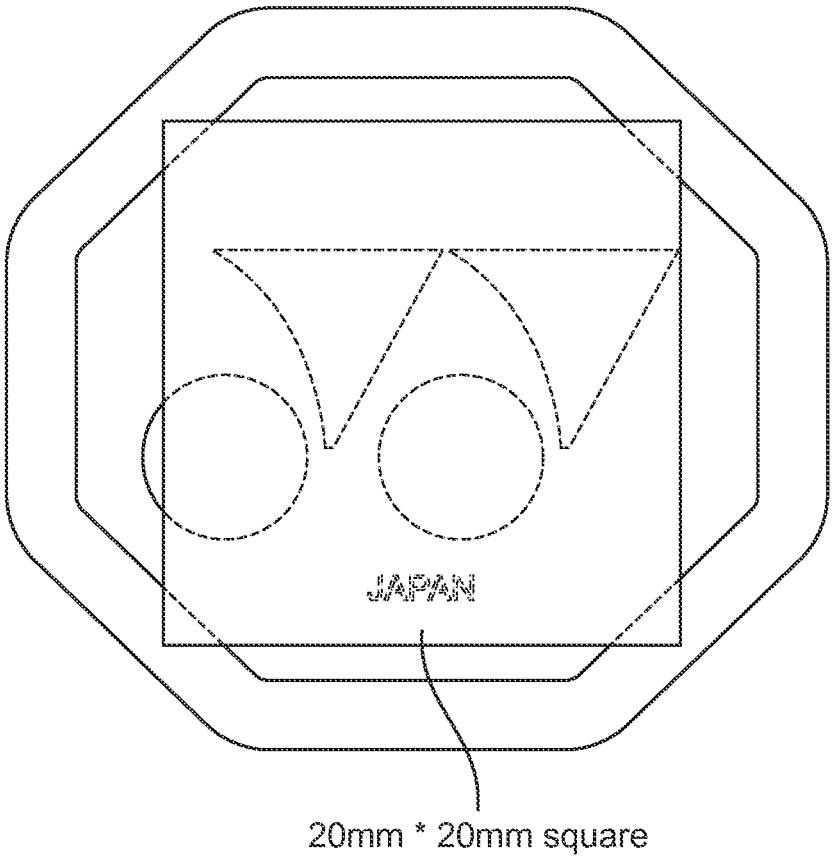
FIG. 4 is an exemplary motion sensor being inserted into a children tennis racket.

FIG. 4 is an exemplary motion sensor being inserted into a children tennis racket. For children tennis rackets or a badminton racket, the bottom cap size is generally small, which limits the maximum size of a motion sensor to be inserted. The provided solution adjusts the motion sensor size to consider the limit for children's sport instruments and provide motion sensors in smaller dimensions while maintaining the functionalities provided by the motion sensors.

Figure 6:
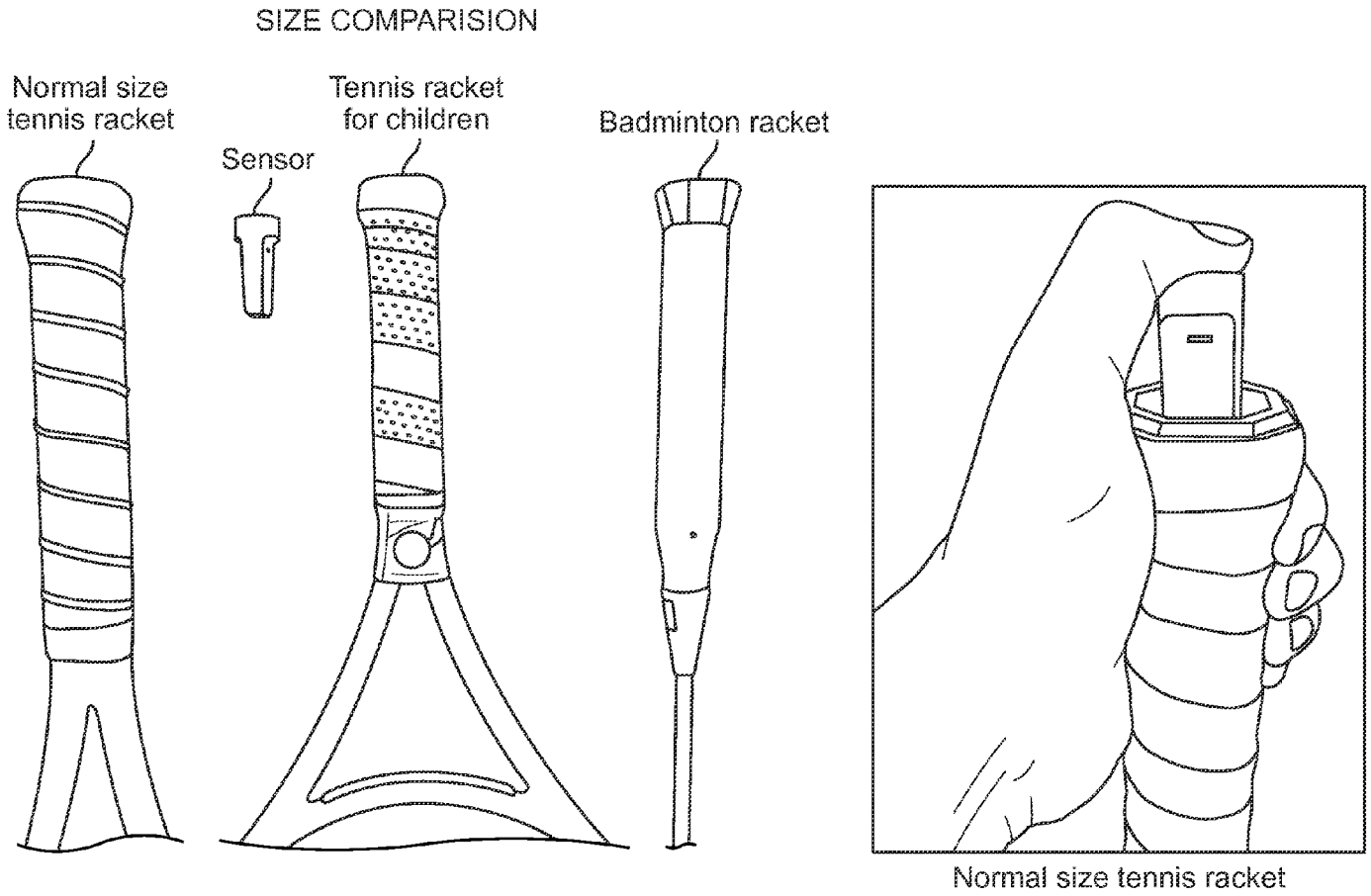
FIG. 6 illustrates inserting a motion sensor into sport instruments in different types and/or different shapes.

FIG. 6 illustrates inserting a motion sensor into sport instruments of different types and/or in different shapes. FIG. 6 shows two types of sport instruments: tennis racket and badminton racket, and two different sizes of a same type sport instrument: normal size of tennis racket and size of children tennis racket. The provide solution offers motion sensors adjustable to fit different types of sport instruments or different sizes of sport instruments. FIG. 6 shows a motion sensor that can be inserted into the different types of sport instruments in different shapes and a motion sensor is being inserted into the bottom part of a normal sized tennis racket.

Figure 7:
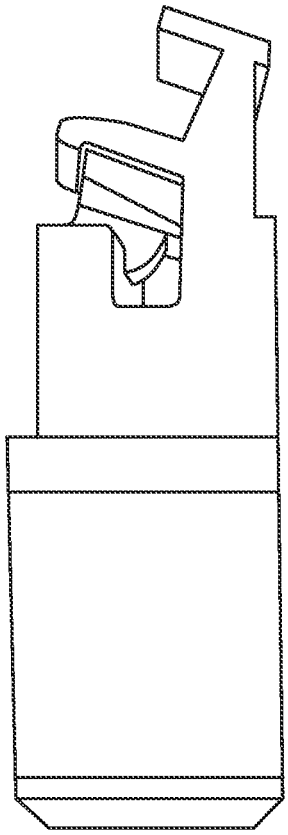
FIG. 7 shows an example of dimensions of a locking mechanism for locking a motion sensor.
Figure 8:
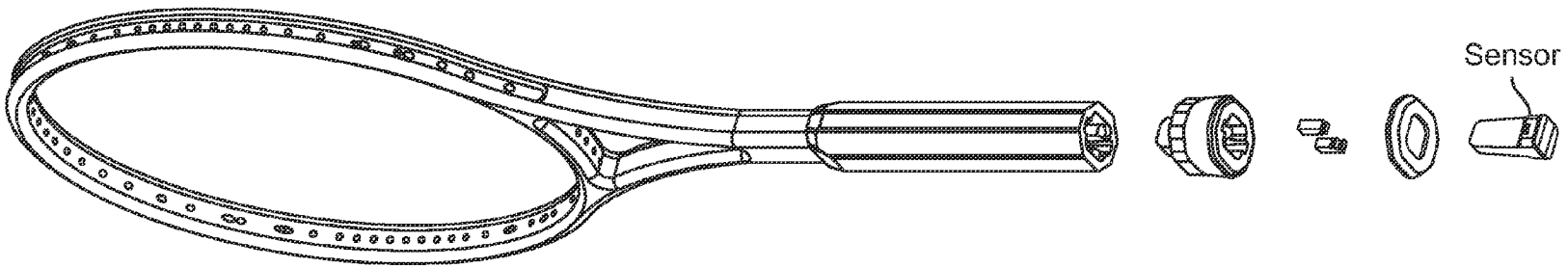
FIG. 8 illustrates a structure of a tennis racket adjusted to insert a motion sensor inside the tennis racket.
Figure 9:
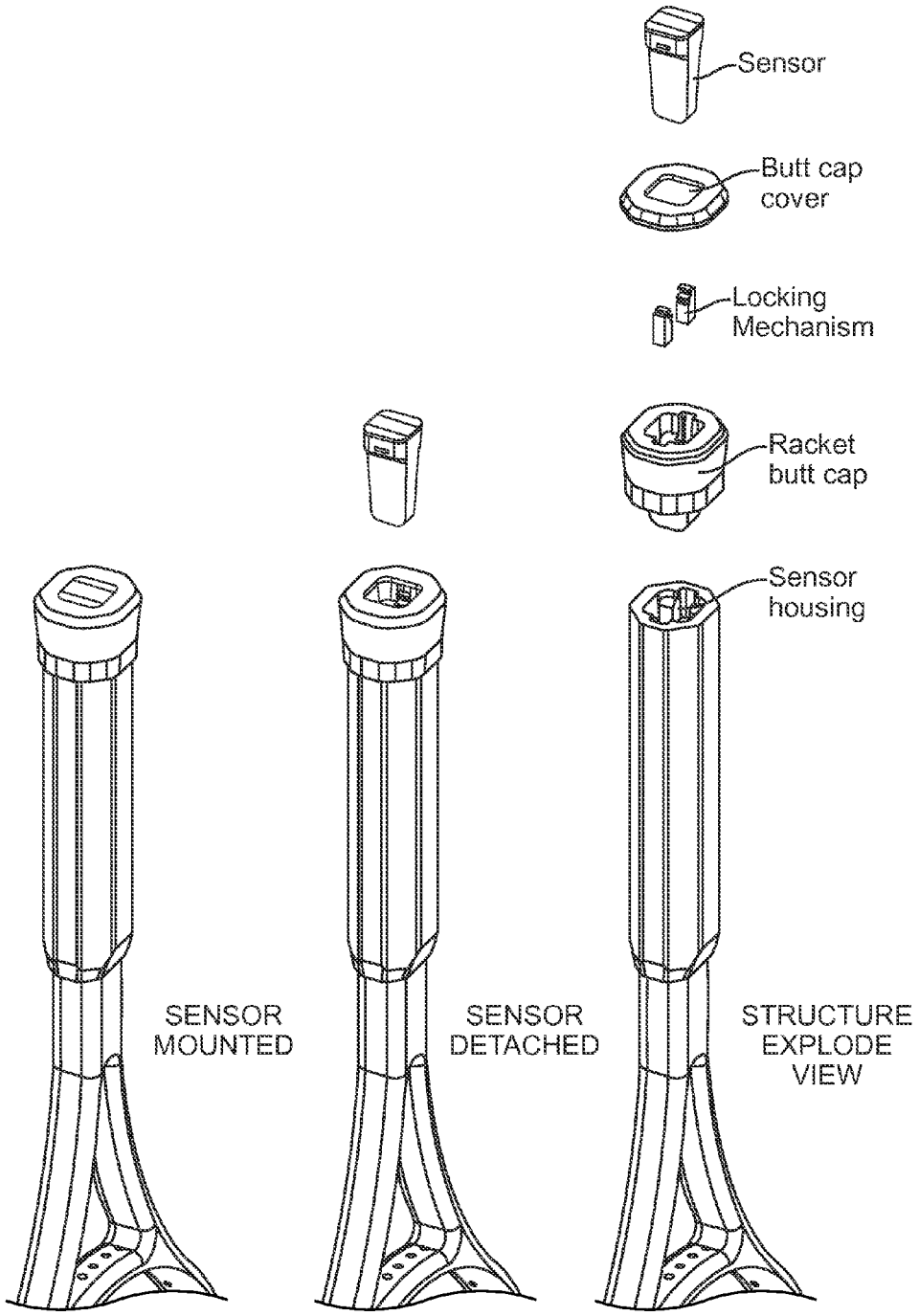
FIG. 9 illustrates steps of mounting a motion sensor to and detaching a motion sensor from a tennis racket and structural view of inserting and locking a motion sensor into a tennis racket.

FIG. 7 shows an example of dimensions of a locking mechanism for a motion sensor. In one embodiment, the dimensions of the locking mechanism for a motion sensor are 5.2 mm by 6.5 mm and 19.2 mm. FIG. 8 illustrates a structure of a tennis racket adjusted to have a motion sensor inserted inside the tennis racket. FIG. 9 illustrates steps of mounting a motion sensor to and detaching a motion sensor from a tennis racket and structural view of inserting and locking a motion sensor into a tennis racket. The structure view of inserting a motion sensor into a tennis racket shows a motion sensor to be inserted, a butt cap cover to protect the insertion, an example locking mechanism, a racket butt cap and a sensor housing to house the motion sensor.

To hold the motion sensor inside the bottom part of the tennis racket, in one embodiment, the provided solution performs the following steps:

- Replace the original racket butt cap with a new one that contains sensor housing, a pair of locking mechanism and a butt cap cover to hold the locking mechanism in position;
- Mill down the center piece (e.g., in carbon or aluminum) on the end of the racket handle to make space for the new butt cap;
- Use shoot nail to fix the new butt cap; and
- Attach a first layer grip tape to secure the insertion.

If a user takes the motion sensor out from the tennis racket, he/she can use a plastic substitution cap that has the similar shape as the top part of the motion sensor. The user can push to lock the substitution cap in position such that the racket weight is not affected.

Figure 10:
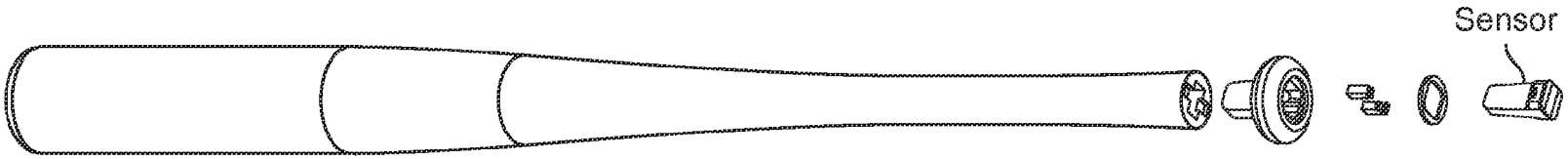
FIG. 10 shows a side view of inserting and locking a motion sensor into a baseball bat.
Figure 11:
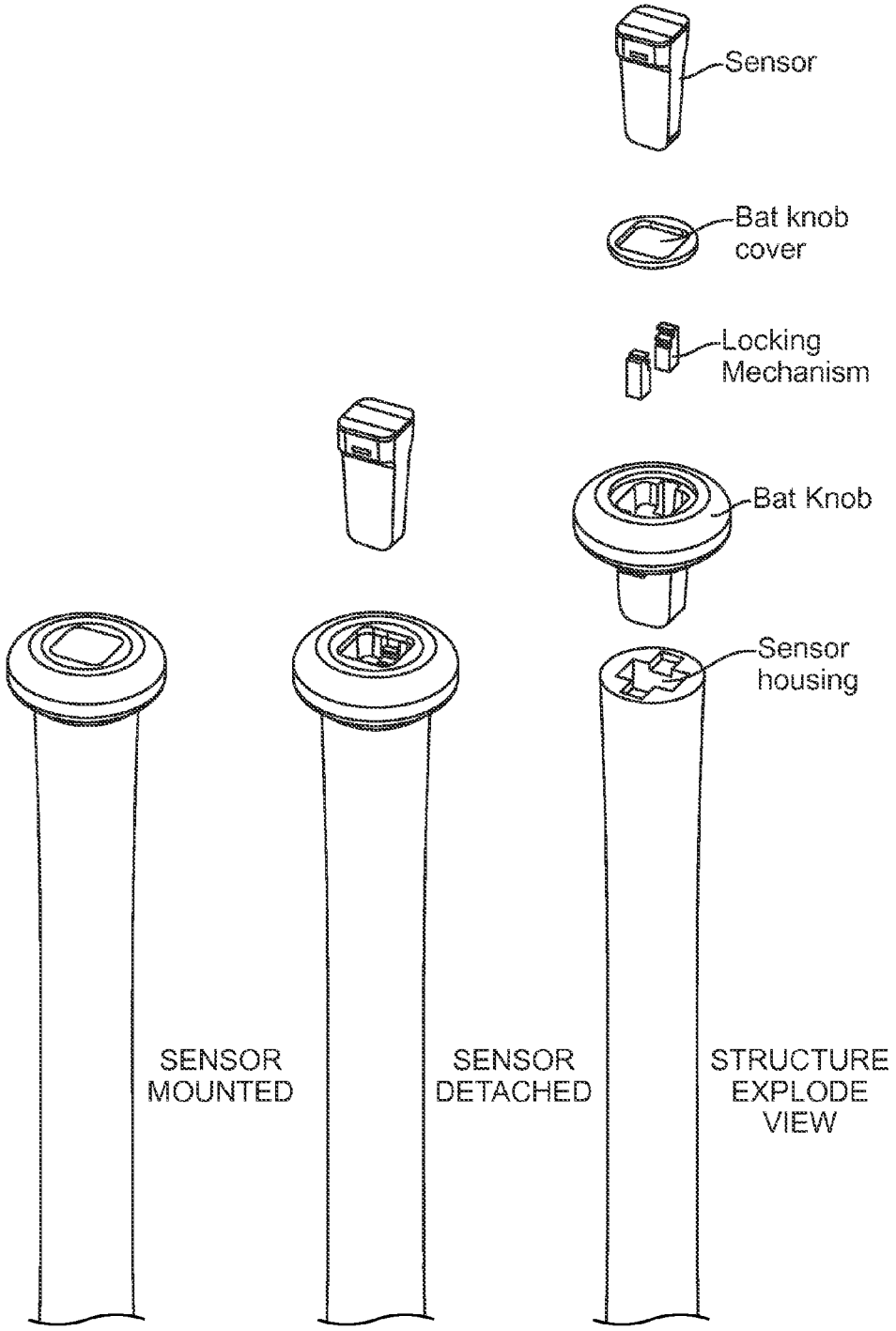
FIG. 11 illustrates steps of mounting a motion sensor to and detaching a motion sensor from a baseball bat and structural view of inserting and locking a motion sensor into a baseball bat.

FIG. 10 shows a side view of inserting and locking a motion sensor into a baseball bat. FIG. 11 illustrates steps of mounting a motion sensor to and detaching a motion sensor from a baseball bat and structural view of inserting and locking a motion sensor into a baseball bat. Similar to the tennis solution as illustrated in FIG. 8 and FIG. 9, the solution for a baseball bat uses a bat knob (instead of a racket butt cap) as the holder of the sensor. The bat knob can be welded or screwed onto the bat neck.

Figure 12:
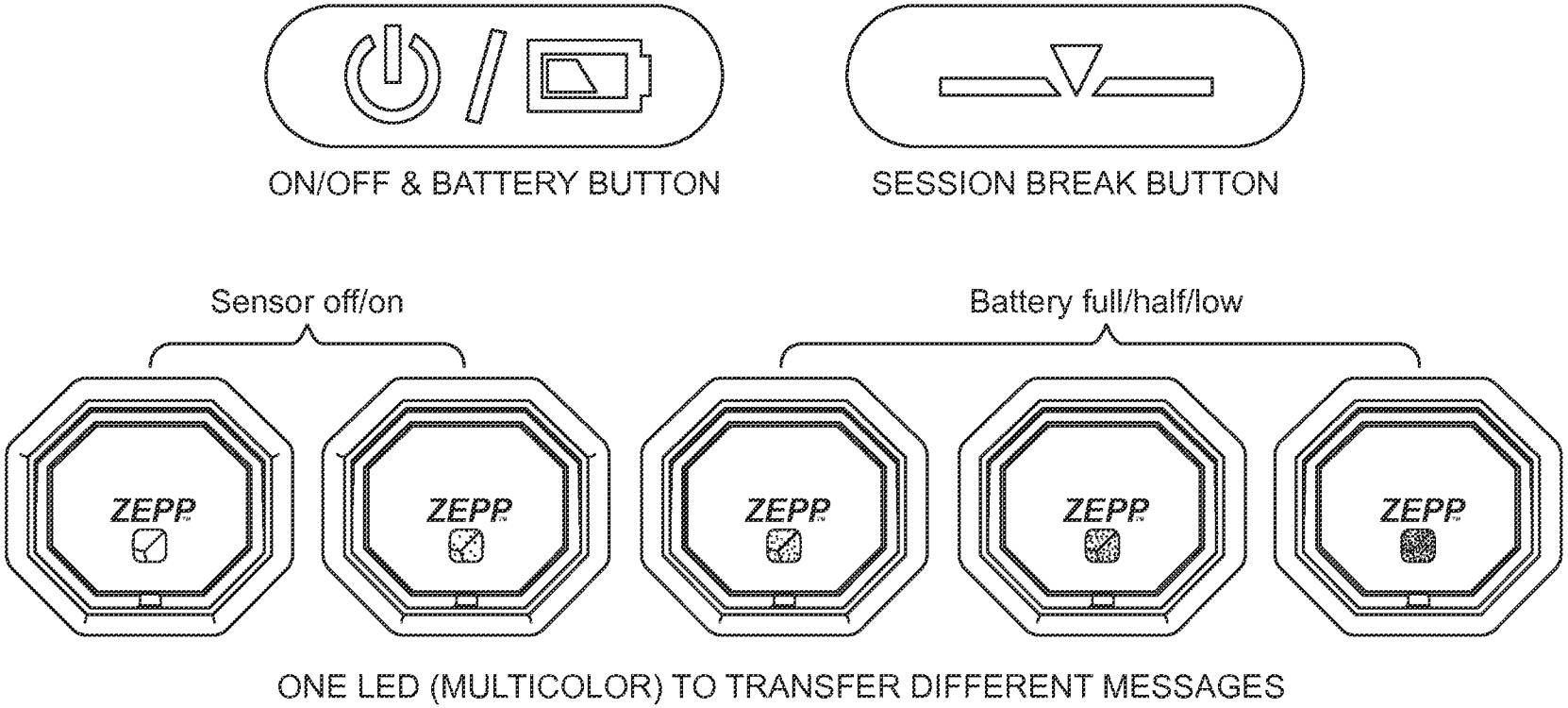
FIG. 12 illustrates examples of motion sensor control buttons and multi-color LED indicators for various status of a motion sensor.

FIG. 12 illustrates examples of motion sensor control buttons and multi-color LED indicators for various status of the motion sensor. In addition to intelligently inserting and locking motion sensors into sport instruments, the provided solution also provides a friendly user interface to indicate various status of the motion sensor in a sport instrument. For example, the solution uses different types of buttons to indicate whether the motion sensor is on/off and to power on/off the sensor or to break a session of a body movement. Additionally, the solution uses one LED with multiple colors to indicate various status of a motion sensor inside a sport instrument.

Figure 13:
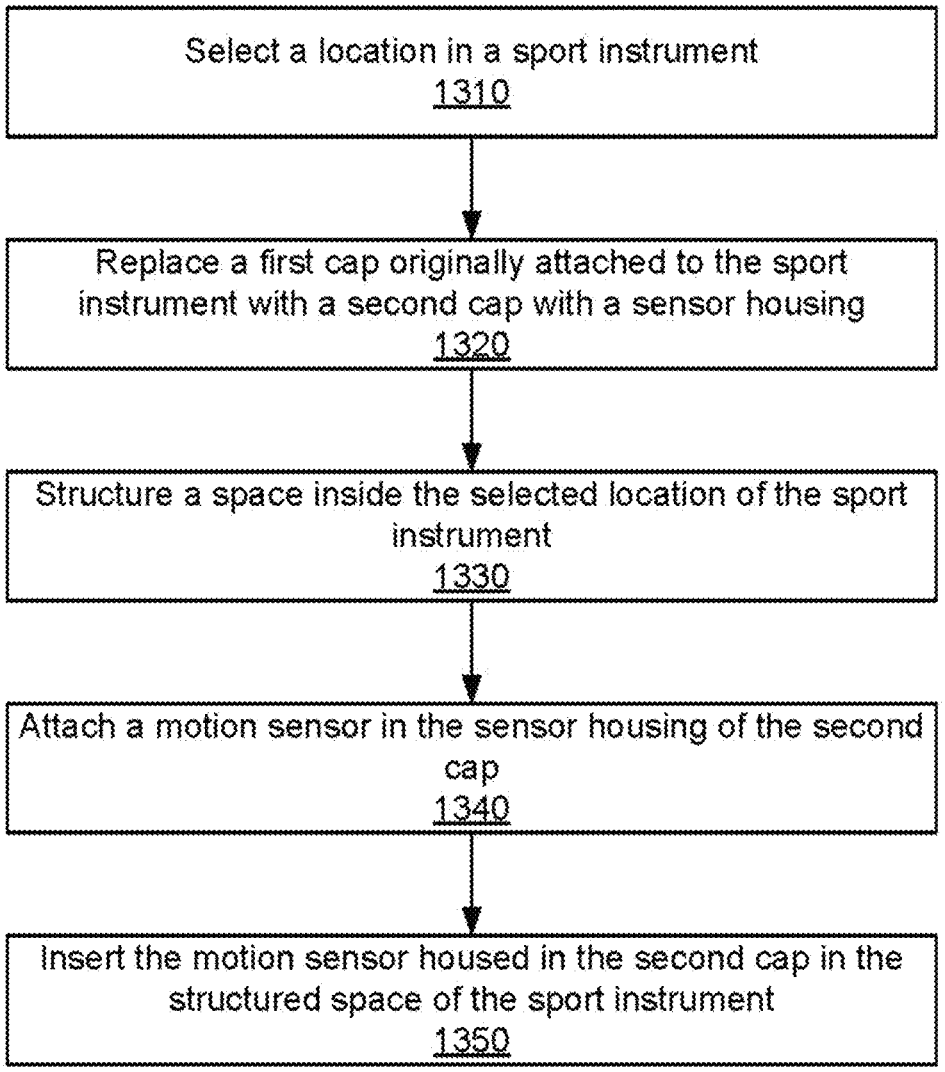
FIG. 13 is an exemplary flowchart illustrating a process for inserting and locking a motion sensor into a sport instrument according to one embodiment.

FIG. 13 is an exemplary flowchart illustrating a process for inserting and locking a motion sensor into a sport instrument according to one embodiment. Initially, a location in a sport instrument, e.g., a tennis butt cap, is selected 1310 for motion sensor insertion. The tennis butt cap originally attached to the tennis racket is replaced 1320 with another butt cap, which is structured to have a space 1330 to house a motion sensor, e.g., as illustrated in FIG. 2. A motion sensor is attached to the structured space 1340 and is inserted 1350 into the tennis racket. The motion sensor is securely locked inside the tennis racket and is detachable for replacement. The insertion and locking of the motion sensor in the tennis racket does not adversely affect a player's hold of the tennis racket. The motion sensor inserted and locked inside the tennis racket is configured to detect motions associated with movements associated with the tennis racket. The motion parameters associated with the detected motion are collected through the embedded motion sensor and analyzed by a motion detection and recognition system for various applications, e.g., generating user friendly performance reports and performance improvement recommendations.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the invention may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A device to insert a motion sensor into a sport instrument, the device comprising:

a motion sensor for detecting motion associated with the movement of the sport instrument;

a cover for protecting the insertion of the motion sensor inside the sport instrument;

a locking mechanism for locking the motion sensor inside a housing, the housing located inside a selected part of the sport instrument, wherein the locking mechanism is configured to secure the motion sensor inside the housing, and wherein the locking mechanism is further configured to release the motion sensor responsive to a tap on the selected part of the sport instrument; and a cap attached to the selected part of the sport instrument for protecting the motion sensor inserted in the selected part of the sport instrument.

2. The device of claim 1, wherein the sport instrument is one of the following:

a tennis racket;

a badminton racket;

a baseball bat;

a golf club; and a sport instrument that has a space to house a motion sensor.

3. The device of claim 1, wherein the sport instrument is in one of a plurality sizes and in one of a plurality of shapes.

4. The device of claim 1, wherein the motion sensor has a square cap.

5. The device of claim 4, wherein dimensions of the motion sensor are approximately 20 millimeters by 20 millimeters by 40 millimeters.

6. The device of claim 1, wherein the motion sensor has a round cap.

7. The device of claim 1, wherein the motion sensor is configured to:

collect motion data associated with the movement of the sport instrument at one or more sampling time, wherein the motion data comprises at least one of acceleration of the sport instrument and an angle of the sport instrument corresponding to a three-dimensional geomagnetic coordinate system;

detect motion of the sport instrument based on analysis of the collected motion data; and generate one or more performance recommendations to a player using the sport instrument based on the motion detection.

8. The device of claim 1, wherein the spring locking mechanism is further configured to be detached from the memory card of the motion sensor for removing the motion sensor from the housing.

9. The device of claim 1, wherein dimensions of the spring locking mechanism are approximately 5.2 millimeters by 6.5 millimeters by 19.2 millimeters.

10. The device of claim 1, wherein the motion sensor has one or more printed circuit boards attached to either a top part of motion sensor or a bottom part of the motion sensor.

11. A method for inserting a motion sensor into a sport instrument, the device comprising:

selecting a location in the sport instrument to insert a motion sensor, the motion sensor configured for detecting motion associated with the movement of the sport instrument;

replacing a cap originally attached to the sport instrument with a new cap, wherein the new cap has a sensor housing to house the motion sensor inside the selected location, a locking mechanism configured to secure the motion sensor inside the selected location in the sport instrument, and a cap cover to hold the locking mechanism;

structuring a space inside the selected location of the sport instrument;

pushing the motion sensor with the new cap into the structured space of the sport instrument to secure the insertion of the motion sensor; and tapping the selected location in the sport instrument to release the motion sensor.

12. The method of claim 11, wherein the sport instrument is one of the following:

a tennis racket;

a badminton racket;

a baseball bat;

a golf club; and a sport instrument that has a space to house a motion sensor.

13. The method of claim 11, wherein the motion sensor is configured to:

collect motion data associated with the movement of the sport instrument at one or more sampling time, wherein the motion data comprises at least one of acceleration of the sport instrument and an angle of the sport instrument corresponding to a three-dimensional geomagnetic coordinate system;

detect motion of the sport instrument based on analysis of the collected motion data; and generate one or more performance recommendations to a player using the sport instrument based on the motion detection.

14. The method of claim 11, wherein the sport instrument is in one of a plurality sizes and in one of a plurality of shapes.

15. The method of claim 11, wherein the motion sensor has a square cap.

16. The method of claim 11, wherein the motion sensor has a round cap.

17. The method of claim 11, wherein the sport instrument is a tennis racket and wherein inserting a motion sensor into the tennis racket comprises:

selecting a location in the tennis racket to insert a motion sensor, the motion sensor configured for detecting motion associated with the movement of the tennis racket;

selecting a racket butt cap to house the motion sensor for the tennis racket based on size, shape and the selected location of the tennis racket, wherein the selected racket butt cap has a sensor housing to house the motion sensor inside the selected location, a locking mechanism and a butt cap cover to hold the locking mechanism;

structuring a space inside the selected location of the tennis racket; and inserting the motion sensor into the sensor housing of the selected racket butt cap; and replacing a cap originally attached to the tennis racket with the selected racket butt cap.

18. The method of claim 17, further comprising:

securing the motion sensor inside the tennis racket with the locking mechanism; and holding the locking mechanism inside the tennis racket with the cap cover.

19. The method of claim 11, further comprising:

replacing the motion sensor inserted into the sport instrument with another motion sensor and its associated cap.

20. The method of claim 11, further comprising:

removing the motion sensor from the sport instrument in response to the releasing of the spring locking mechanism.

* * * * *